US005772314A

United States Patent [19]

Brumer

[11] Patent Number: 5,772,314

[45] Date of Patent: Jun. 30, 1998

[54] CEILING ORNAMENT SYSTEM

[76] Inventor: Daryl J. Brumer, 1704 W. Shore Dr., Delafield, Wis. 53018

[21] Appl. No.: 528,812

[22] Filed: Sep. 15, 1995

[51] Int. Cl.[6] ..... F21V 11/14

[52] U.S. Cl. ..... 362/360; 362/147; 362/284; 362/324; 362/361; 362/806

[58] Field of Search ..... 362/147, 351, 362/361, 367, 404, 406, 408, 456, 806, 148, 150, 282, 284, 354, 360, 324, 96, 376; 40/579, 564, 473, 502; 52/311.3, 673, 674, 676

[56] References Cited

U.S. PATENT DOCUMENTS

| | | | |
|---|---|---|---|
| 863,178 | 8/1907 | Holt et al. | 362/361 |
| 987,245 | 3/1911 | Langstaff | 40/502 |
| 1,331,494 | 2/1920 | Garfunkel | 362/404 |
| 1,962,648 | 6/1934 | Pflueger | 362/148 |
| 2,196,214 | 4/1940 | Kantack | 362/408 |
| 2,680,841 | 6/1954 | Boutelle | 362/405 |
| 2,783,366 | 2/1957 | Jellinek | 362/10.1 |
| 2,939,543 | 6/1960 | Zingone | 362/150 |
| 3,019,334 | 1/1962 | Lipscomb | 362/354 |
| 3,396,497 | 8/1968 | Murphy | 362/150 |
| 4,272,804 | 6/1981 | Blum | 362/150 |
| 4,338,547 | 7/1982 | McCaslin | 315/312 |
| 4,344,114 | 8/1982 | Denhart | 362/374 |
| 4,471,596 | 9/1984 | Deaton et al. | 362/354 |
| 4,768,140 | 8/1988 | Szpur | 362/367 |
| 4,839,778 | 6/1989 | Wall, Jr. | 362/150 |
| 5,128,850 | 7/1992 | Juodvalkis | 362/352 |
| 5,130,915 | 7/1992 | Lerch | 362/361 |

*Primary Examiner*—Alan Cariaso

*Attorney, Agent, or Firm*—Andrus, Sceales, Starke & Sawall

[57] ABSTRACT

A ceiling ornament system for a ceiling mounted light arrangement includes a flat parabolically shaped non-translucent sheet assembly fixedly or rotatably supported from the ceiling. The light arrangement is formed by an array of horizontally disposed lighting fixtures, each of which has a base depending directly from the bottom of the ceiling. The sheet assembly has holes, preferably arranged in a celestial pattern, which transmit light from the light arrangement through the sheet assembly.

26 Claims, 6 Drawing Sheets

FIG. 3
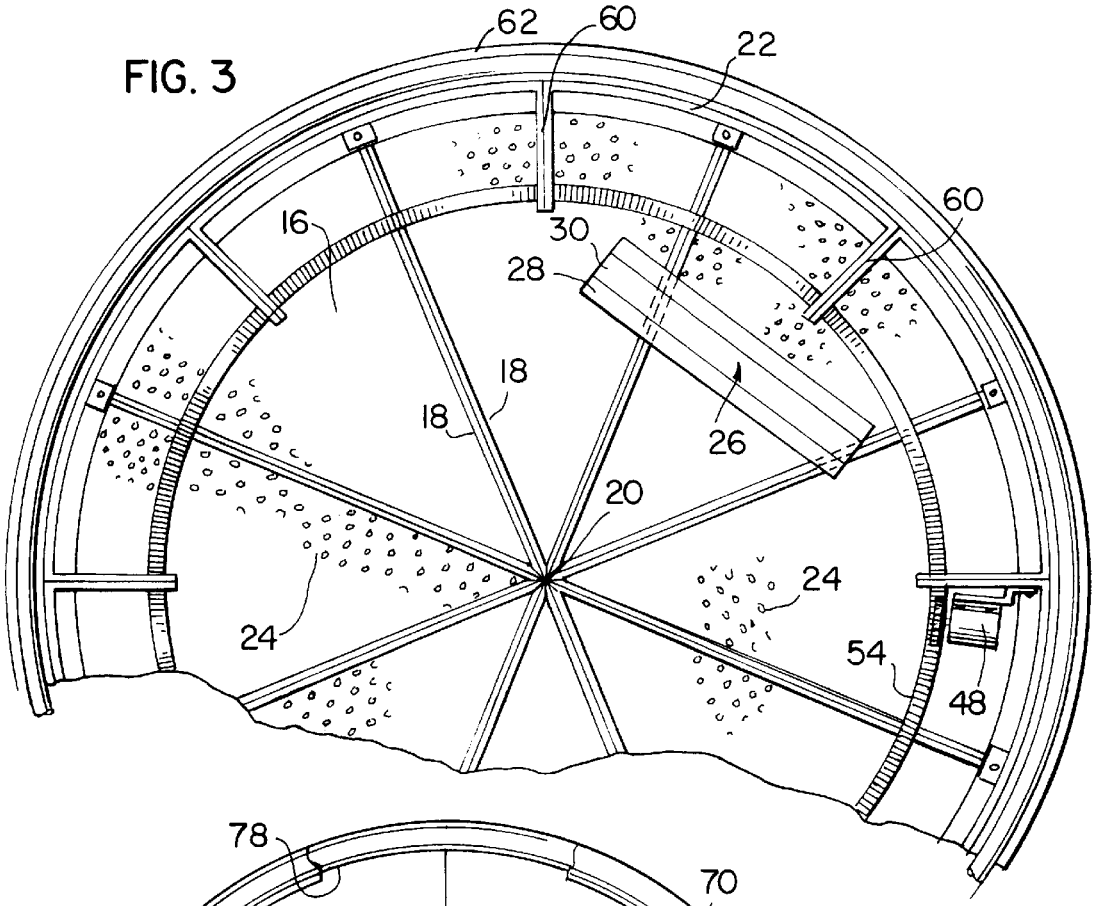
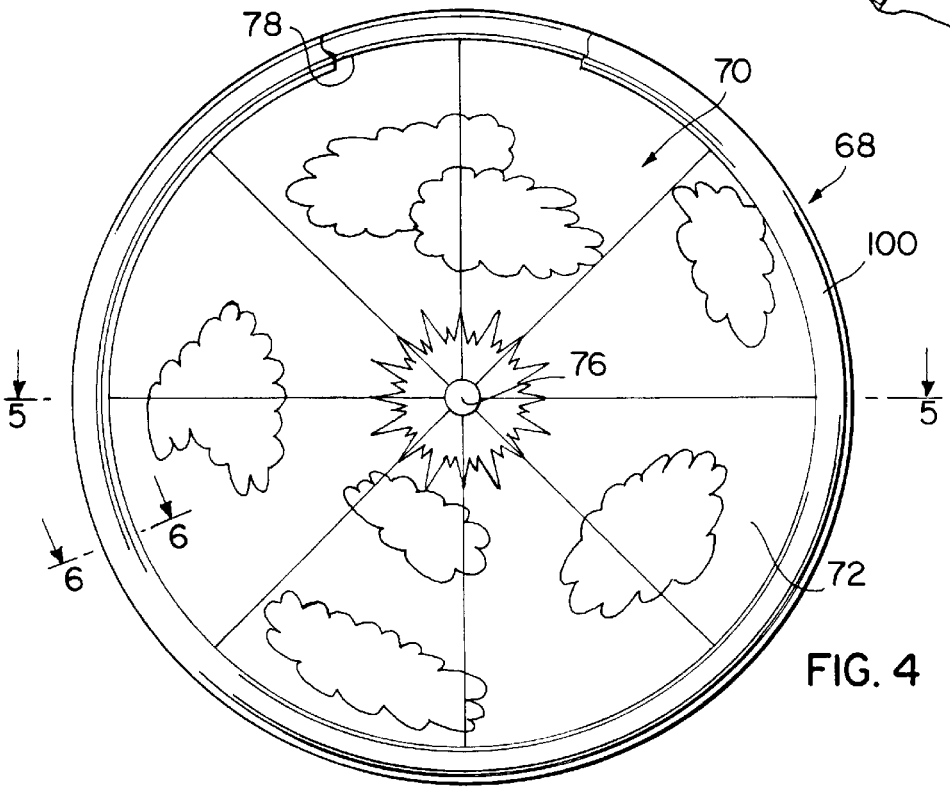
FIG. 4

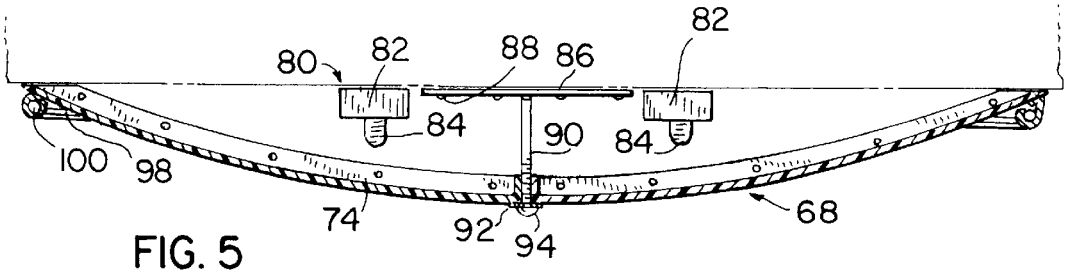
FIG. 5
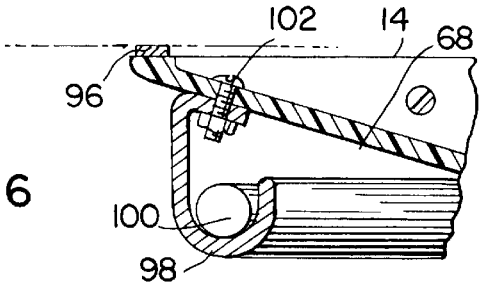
FIG. 6
FIG. 7
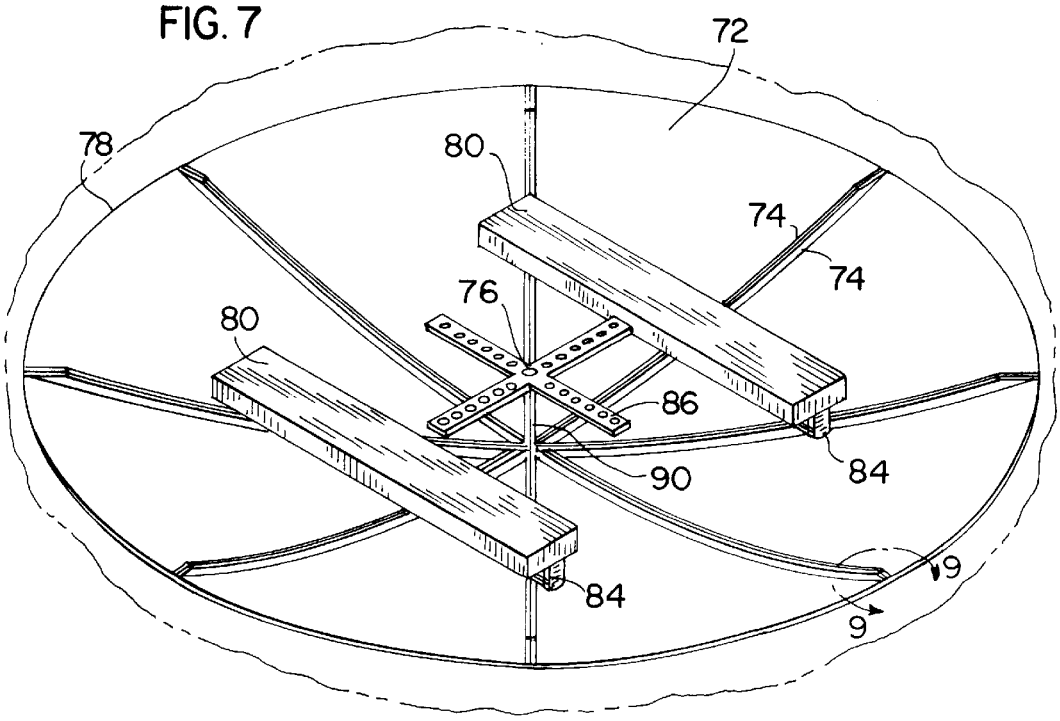

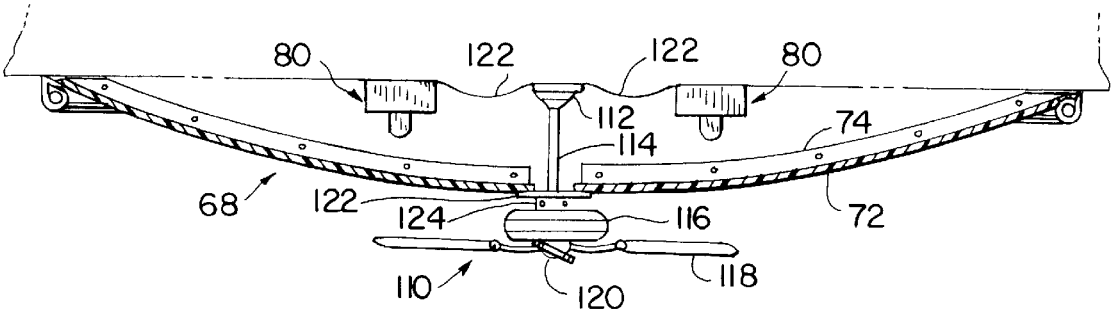
FIG. 8
FIG. 9
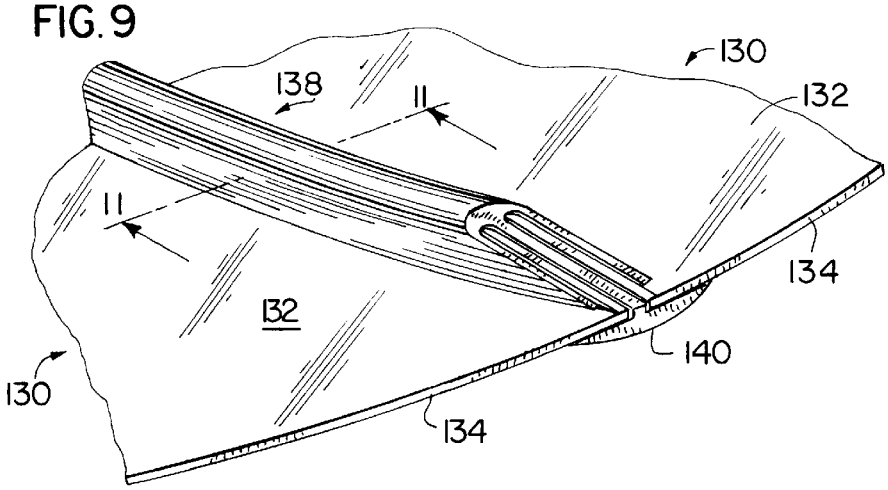
FIG. 10
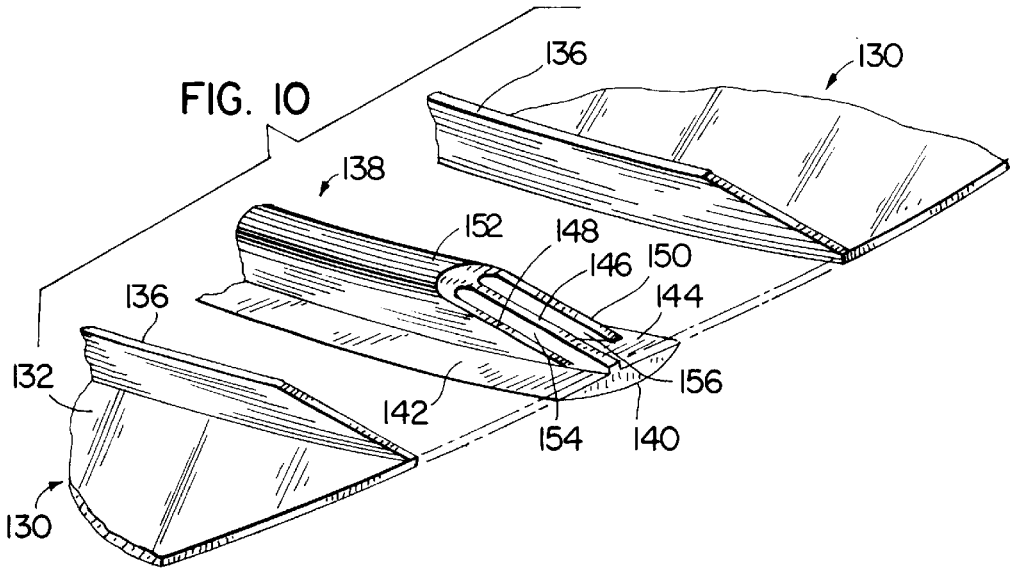

CEILING ORNAMENT SYSTEM

TECHNICAL BACKGROUND AND BACKGROUND OF THE INVENTION

This invention relates generally to ceiling ornament systems for ceiling mounted lighting arrangements, and more particularly, pertains to an aesthetically pleasing ceiling ornament system which provides variant light transmission through a backlit, non-translucent sheet assembly.

It is well known to provide ceiling ornament systems having a backlit decorative cover for ceiling mounted light fixtures which provide various degrees of direct as well as diffused lighting while continuing to offer an aesthetically pleasing effect. Such covers tend to be comprised of plastic or fiberglass, translucent material which assume various configurations and are normally fixed to the bottom of the ceiling.

While such ornamental ceiling systems have been generally acceptable to the buying public, there remains a need for a more versatile system which will offer a wider combination of visual effects while remaining reasonable in cost and relatively simple to install and maintain. It is particularly desirable to provide a combination of backlit and accent lighting in a ceiling suspended decorative cover. Furthermore, it is desirable to provide the user with a stationary or driven rotatable decorative cover. Moreover, it is aesthetically desirable to provide such light treatment through the medium of a parabolically shaped decorative cover.

SUMMARY OF THE INVENTION

The inventive ceiling ornament system advantageously provides a relatively simple, economically feasible decorative ceiling ornament arrangement wherein holes or decorative indicia on the cover are backlit to provide an aesthetically attractive device. The system contemplates both stationary and rotatably driven decorative covers which provide diffused as well as direct illumination, and also contemplates optional peripheral accent lighting.

These and other aspects of the invention are realized in a ceiling ornament system for a ceiling mounted light arrangement comprising a parabolically shaped sheet assembly having a series of holes therethrough in a celestial pattern, and supported from the ceiling. The sheet assembly may have decorative indicia formed thereon, in combination with the series of holes. The light arrangement is formed by an array of horizontally disposed lighting means providing illumination, each of the lighting means having a base depending directly from the bottom of the ceiling. Securing means are employed to fasten the parabolically shaped sheet assembly to the ceiling. In one form, the sheet assembly defines a convex parabole, and the securing means engages the sheet assembly at a locus defined by the maximum distance between the periphery of the sheet assembly and curvature of the parabolically shaped sheet assembly. In another form, the sheet assembly defines a concave parabole, and the securing means extends through substantially the center of the sheet assembly to secure it to the ceiling.

The present invention contemplates a parabolically shaped sheet assembly having a series of interconnected sections, each of which is joined together along abutting flanges formed on each of the sections and extending from the center of the parabolically shaped sheet assembly to the periphery of the parabolically shaped sheet assembly.

The ceiling ornament system embodying the present invention includes both stationary and rotatable parabolically shaped sheet assemblies, each of which may include accent lighting adjacent the periphery of the parabolically shaped sheet assembly. The stationary version, which is preferably in the form of a concave parabole, employs a securing means in the form of a single stud arrangement extending between the bottom of the ceiling and the center of the parabolically shaped sheet assembly. The rotatable version, which is preferably in the form of a convex parabole, includes a securing means in the form of a bezel extending between the bottom of the ceiling and the periphery of the parabolically shaped sheet assembly.

BRIEF DESCRIPTION OF THE DRAWINGS

The invention will become better understood by reference to the following detailed description of the preferred exemplary embodiment when read in conjunction with the appended drawing wherein like numerals denote like elements.

FIG. 3 is a fragmentary, enlarged top view of the ceiling ornament shown in FIG. 1, with reference to line 3—3 of FIG. 1;

FIG. 4 is an alternative embodiment of a stationary ceiling ornament embodying the present invention;

FIG. 5 is a cross-sectional view taken on line 5—5 of FIG. 4;

FIG. 6 is an enlarged detail view of the peripheral structure shown in FIG. 5;

FIG. 7 is a perspective view taken from the top of FIG. 5;

FIG. 8 is a view similar to FIG. 5 illustrating an alternative embodiment of the invention adapted for use in combination with a ceiling fan;

FIG. 9 is isometric view of a portion of the ceiling ornament system of FIG. 7, showing an alternative construction for the parabolic assembly;

FIG. 10 is an exploded isometric view of the portion of the parabolic assembly of FIG. 9;

DETAILED DESCRIPTION OF THE PREFERRED EMBODIMENTS

Figure 1:
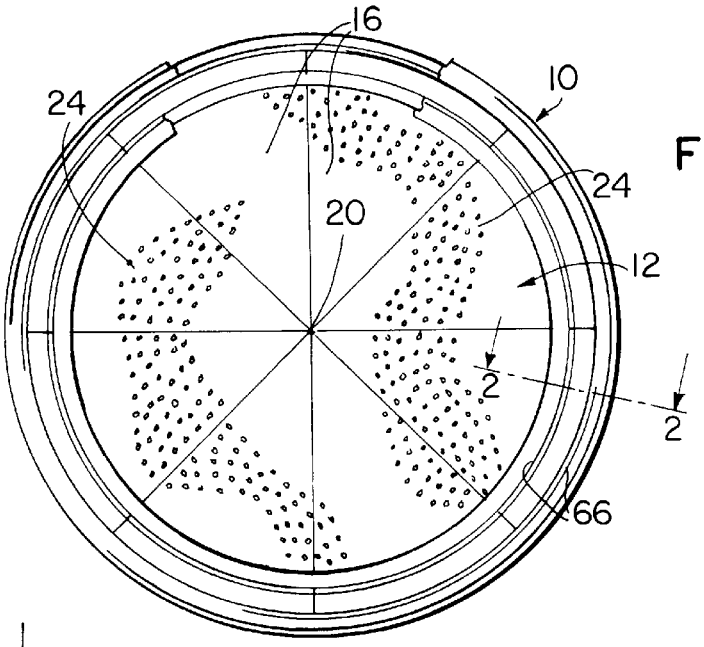
FIG. 1 is a bottom view of a rotating ceiling ornament embodying the present invention.
Figure 2:
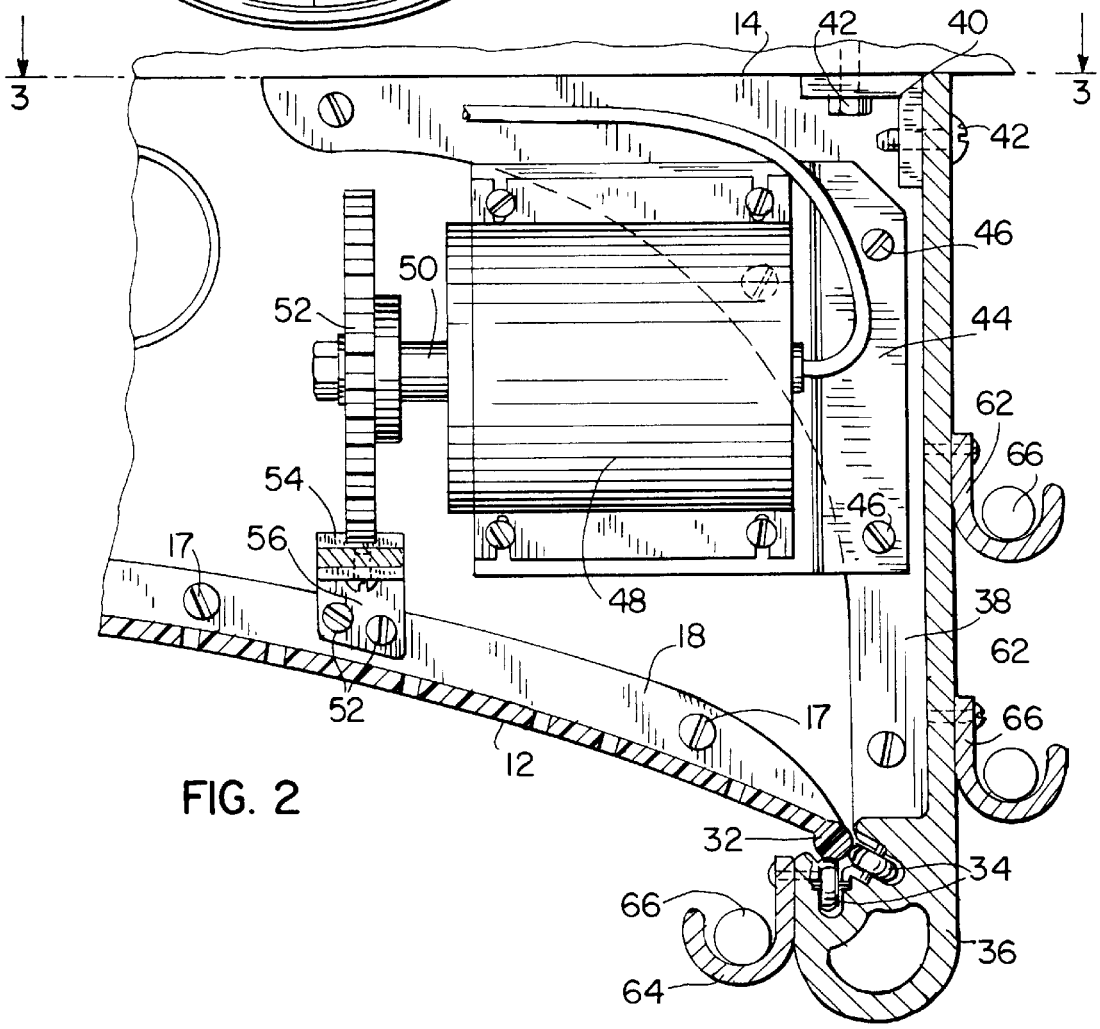
FIG. 2 is an enlarged cross-sectional view taken on line 2—2 of FIG. 1.

Referring now to the drawings and, in particular FIGS. 1–3, the ceiling ornament system of the present invention is generally identified by the numeral 10. System 10 comprises a parabolically shaped, plastic or fiberglass sheet assembly 12 formed with decorative indicia and supported from the bottom of a ceiling 14 in a manner to be described hereinafter. In the preferred embodiment, sheet assembly 12 takes the form of a circular, inverted dish defined by a series of eight equally sized, pie-shaped, interconnected sections 16, each of which is joined together with fasteners 17 along abutting flanges 18 integrally formed on each of the sections 16 and extending, in this case, radially from the center 20 of the parabolically shaped sheet assembly 12 to the periphery 22 thereof. Each of the sections 16 is formed with an array of pin holes 24 which collectively form an aesthetically pleasing design, e.g. a celestial pattern. Optionally, each section 16 may have a decorative indicia on its outer surface. Pin holes 24 are sufficiently small, on the order of 1/64" to 1/8", so as to be practically invisible during daylight and ambient light conditions.

The shell of each section 16 may be formed of any satisfactory non-translucent material, e.g. copper, brass, or plastic or fiberglass having its inside surface coated with a light-reflective paint.

A light arrangement disposed between the ceiling 14 and sheet assembly 12 and formed by four horizontally disposed fluorescent lights 26 provides illumination, a portion of which is transmitted directly through pin holes 24 to provide a celestial effect when the room is darkened. Each of fluorescent lights 26 has a base 28 which is rigidly mounted to the bottom of ceiling 14 and functions to retain a removable fluorescent light bulb 30.

As best seen in FIG. 2, the peripheral edge 32 of sheet assembly 12 is supported for rotation on a series of bearing wheels 34 provided on the bottom end 36 of an L-shaped bezel 38, which is secured by an angle bracket 40 to the bottom of ceiling 14 by fasteners 42. Bezel 38 also serves to support a mounting plate 44 by means of fasteners 46 which, in turn, mounts an electric motor 48 between the bottom of ceiling 14 and the top of sheet assembly 12. Motor 48 includes a driver shaft 50 having a gear wheel 52 which is engageable with a continuous gear track 54 secured in a circular path by a plurality of gear track brackets 56 mounted on flanges 18 by means of fasteners 58. Auxiliary support brackets 60 extend inwardly from the periphery 22 of sheet assembly 12 and further secure gear track 54 in place. Continuous, U-shaped troughs 62 are anchored one on top of another along the outer surface of bracket 38. Another continuous trough 64 is disposed on the inside of the bottom end 36 of bracket 38. Troughs 62,64 are optionally employed to retain accent lighting 66 in the form of fluorescent tubes, neon tubes, or optical fibers.

With the above described structure, there is provided an improved ceiling ornament system for ceiling mounted light fixtures which enables the direct transmission of light through holes in a celestial pattern in a rotatably driven parabolically shaped sheet assembly. The inventive system efficiently combines backlighting of the sheet assembly with optional accent lighting at the periphery of the sheet assembly to provide a novel, aesthetically pleasing and versatile lighting treatment. Depending on the shape of the pin hole array, one can appreciate the variable effect of light distribution or diffusion through sheet assembly during rotation thereof.

If desired, system 10 may be installed in a recess, or other similar accommodation formed in ceiling 14.

Turning now to FIGS. 4–7, an alternative embodiment of a ceiling ornament system 68 comprises a parabolically shaped sheet assembly 70 which takes the form of a circular dish similarly formed by a series of eight, equally sized, pie-shaped interconnected sections 72, each joined along abutting flanges 74 formed on each of the sections and extending radially from the center of sheet assembly 70 to the periphery 78 thereof. In this case, sheet assembly 70 is provided with decorative indicia of any form, e.g. a cloud and sunburst as illustrated. In addition, a series of pin holes having a celestial pattern are formed in sheet assembly 70. A light arrangement disposed between the bottom of ceiling 14 and the top of sheet assembly 70 is formed by two horizontally disposed fluorescent lights 80 lying parallel to each other. Light arrangement provides illumination, all of which is transmitted directly through the pattern of pin holes in sheet assembly 70. Each light 80 has a base 82 which is rigidly mounted to the bottom of ceiling 14 and functions to retain a removable fluorescent light bulb 84.

At the periphery 78 of each section, an inwardly extending horizontal flange may be formed to abut the ceiling. In addition, the sections 72 may be formed with abutting, upwardly extending lips, and flanges 74 may be replaced with separate reinforcing members which sandwich the lips together to interconnect adjacent sections 72. Such reinforcing members may be made of any satisfactory material such as radiused conduit or wood, and may engage a peripheral rod at their outer ends disposed below the inwardly extending flange on the outer, upper edge of each section 72.

In contrast to the first described embodiment, ceiling ornament system 68 has a crossbrace 86 secured to the bottom of ceiling 14 by fasteners 88. Depending downwardly from the center of crossbrace 86 is a support stud 90, the bottom of which serves as a junction or anchor point for each pair of abutting flanges and carries a screwthreaded portion 92 on which a retainer 94 is screwed to bring the peripheral edges of sheet assembly 68 provided with weatherstripping 96 flush against the bottom of ceiling 14. At the desire of the user, an optional continuous trough 98 is secured to the bottom of sheet assembly 68 by fasteners 100 for the purpose of carrying accent lighting in the form of fluorescent tubing or optical fibers 102.

With the structure of FIGS. 4–7, there is provided an improved ceiling ornament system for ceiling mounted light fixtures which enables direct transmission of light through a pattern of holes formed in a stationary, non-translucent parabolically shaped sheet assembly. This version again provides backlighting of the sheet assembly with optional accent lighting to provide a different yet pleasing effect in comparison to the embodiment of FIGS. 1–3.

FIG. 8 illustrates a version of the invention somewhat similar to that shown in FIG. 5, and like reference characters will be used where possible to facilitate clarity. In this embodiment, a ceiling fan assembly 110 is mounted to the ceiling. Ceiling fan assembly 110 is conventional in construction, and includes a base 112, a depending support tube 114, and includes motor unit 116 and a series of blades 118 extending from a hub 120. In accordance with the invention, electrical cables 122 extend from fan base 112 to light fixtures 80.

Ornament system 68 is substantially as shown and described in connection with FIG. 5. In this version, however, ornament system 68 is supported via a plate 122 and a retaining ring 124, which are interposed between the upper surface of motor unit 116 and the lower surfaces of sections 72 adjacent the central opening defined by sections 72 and flanges 74. Plate 122 is a split plate defined by mirror-image sections, each of which includes a cut-out. The cut-outs in the plate sections receive support tube 114 when the plate sections are fitted together. Retaining ring 124 is also of a split-type construction, enabling it to be fitted about support tube 114. Retaining ring 124 includes a series of threaded, laterally extending pressure studs which engage support tube 114 at several points about its periphery, so as to securely clamp retaining ring 124 in position on support tube 114 and to support ornament system 68 thereabove through plate 122. As can be appreciated, this type of mounting system enables ornament system 68 to be mounted to various types of ceiling fan assemblies having differing lengths of support tubes. In an application such as this, the components of ceiling ornament system 68 are formed of a lightweight material, such as plastic or the like, so as to decrease the overall amount of weight being supported by ceiling fan assembly support tube 114.

Figure 11:
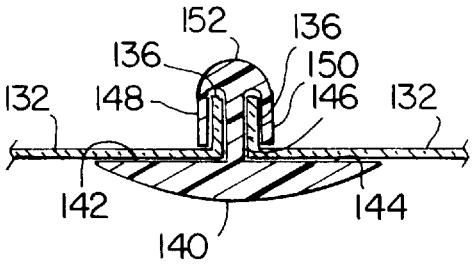
FIG. 11 is a partial section view taken along line 11—11 of FIG. 9.

FIGS. 9–13 illustrate alternative constructions for the parabolic shell of ornament system 68. In the embodiment of FIGS. 9–11, each shell section 130 includes a triangular wall 132 having side edges which converge toward each other in an outward-to-inward direction, extending inwardly from an outer edge 134. A flange 136, extending perpendicularly to wall 132, is provided at each side edge of each wall 132, extending upwardly therefrom. A connecting rib 138 is provided for securing adjacent sections 130 together. Rib 138 includes a base section 140 having a curved bottom surface and flat, opposed, upwardly facing side surfaces 142, 144. A central wall 146 extends upwardly from base 140 between side surfaces 142, 144, and depending side walls 148, 150 are interconnected with the upper end of central wall 146 via an upper section 152 of rib 138, so as to form a pair of channels 154, 156 located one on either side of central wall 146. Sections 130 are positioned relative to rib 138 so that flanges 136 are aligned with channels 154, 156, and sections 130 are then slid on rib 138 so as to interconnect adjacent sections 130 to form a parabolic assembly having a construction essentially the same as that illustrated in FIG. 7. Ribs 138 are interconnected at their inner ends, extending radially outwardly from the center of the parabolic assembly.

Figure 14:
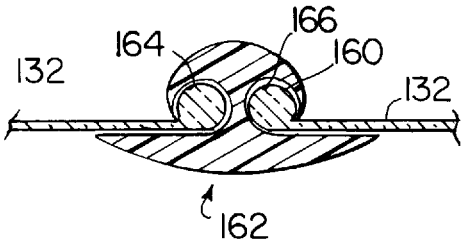
FIG. 14 is a partial section view taken along line 14—14 of FIG. 12.
Figure 12:
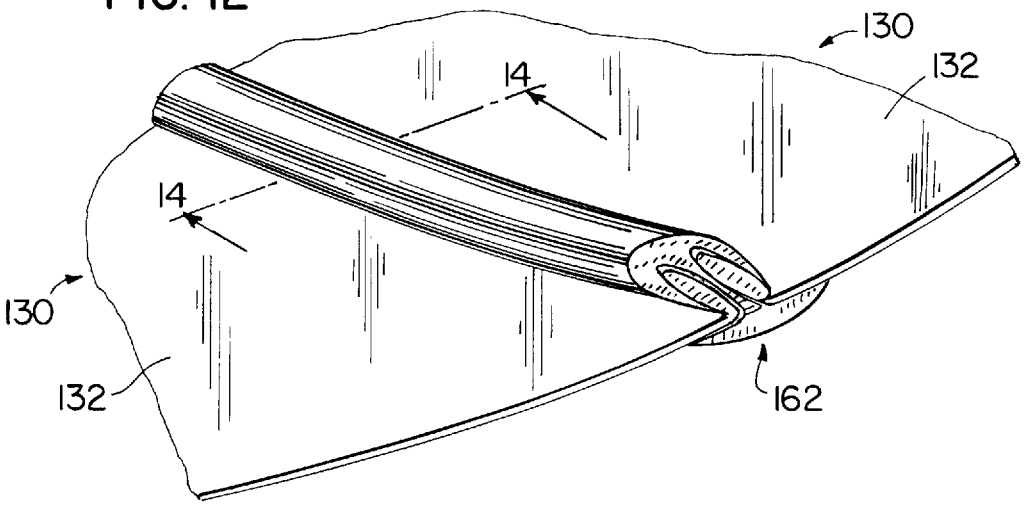
FIG. 12 is a view similar to FIG. 9, showing yet another alternative construction for the parabolic assembly.
Figure 13:
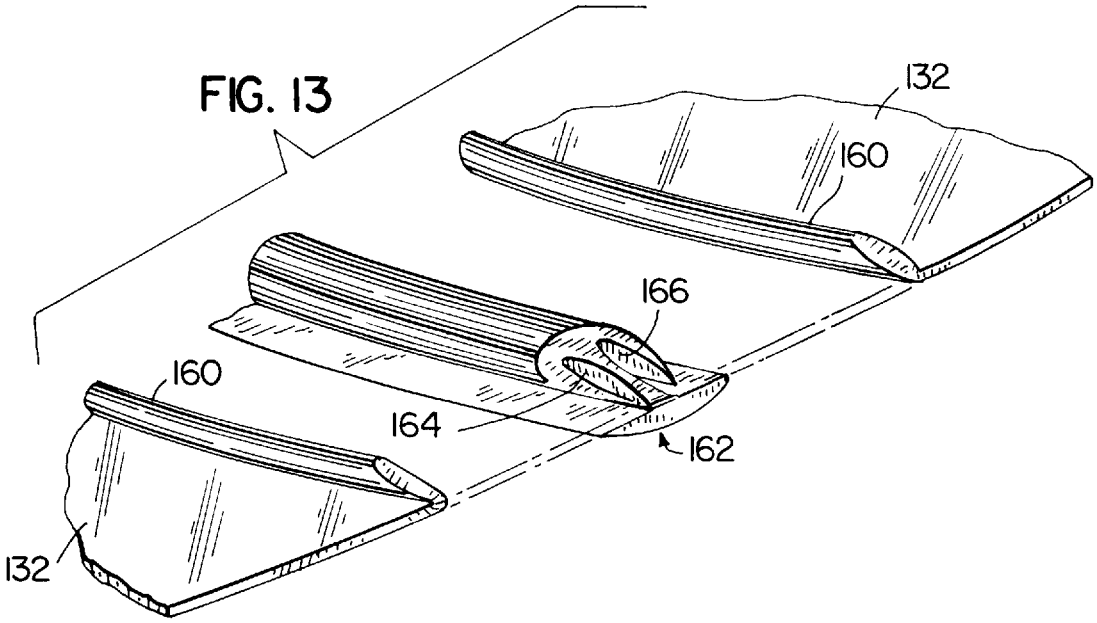
FIG. 13 is an exploded isometric view of the portion of the parabolic assembly illustrated in FIG. 12.

FIGS. 12–14 illustrate a similar construction to that illustrated and described with respect to FIGS. 9–11. In this construction, rounded bead sections 160 are formed at the side edges of each section 130, and a rib 162, formed similarly to rib 138, defines spaced passages 164, 166 on either side of the center line, which are shaped so as to receive rounded bead sections 160 and to retain sections 160 within passages 164, 166.

Figure 15:
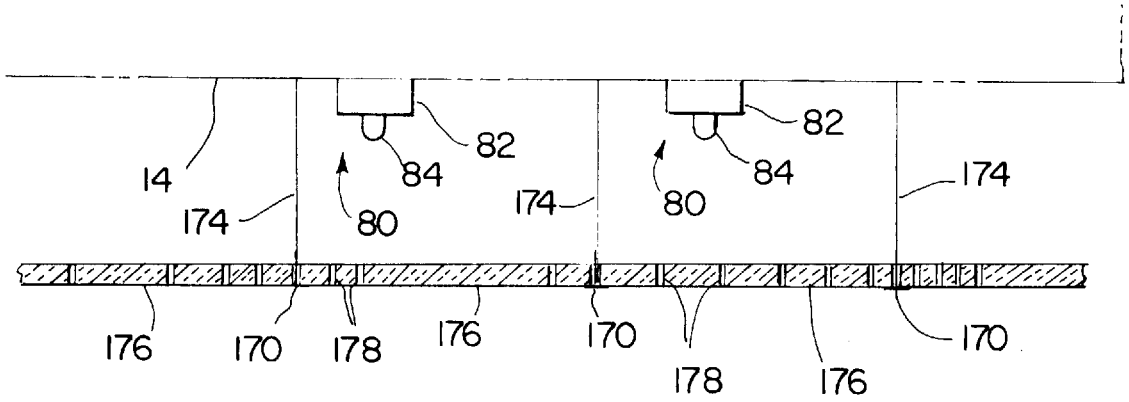
FIG. 15 is a view similar to FIGS. 5 and 8 illustrating an alternative embodiment of the invention.

FIG. 15 illustrates yet another embodiment of the invention, and like reference characters will be used where possible to facilitate clarity. As in the prior embodiments, the bases 82 of lights 80 are again mounted to the bottom of ceiling 14. In this embodiment, a suspended ceiling assembly is secured to ceiling 14. The construction of the suspended ceiling assembly is generally conventional, including inverted T-shaped rails 170, 172 suspended from ceiling 14 via hanger wires 174. Tiles 176 are placed within the spaces defined by rails 170, 172.

In accordance with the invention, apertures or openings 178 are formed in tiles 176. Apertures 178 extend completely through tiles 176, to enable light from bulb 84 to pass through tiles 176. This way, the pattern of apertures 178 forms a pattern of light in the room when there is no light from other sources within the room. Preferably, lights 80 are controlled by an electrical circuit separate from other room light sources to enable a user to actuate only lights 80 when the room is otherwise dark.

Figure 16:
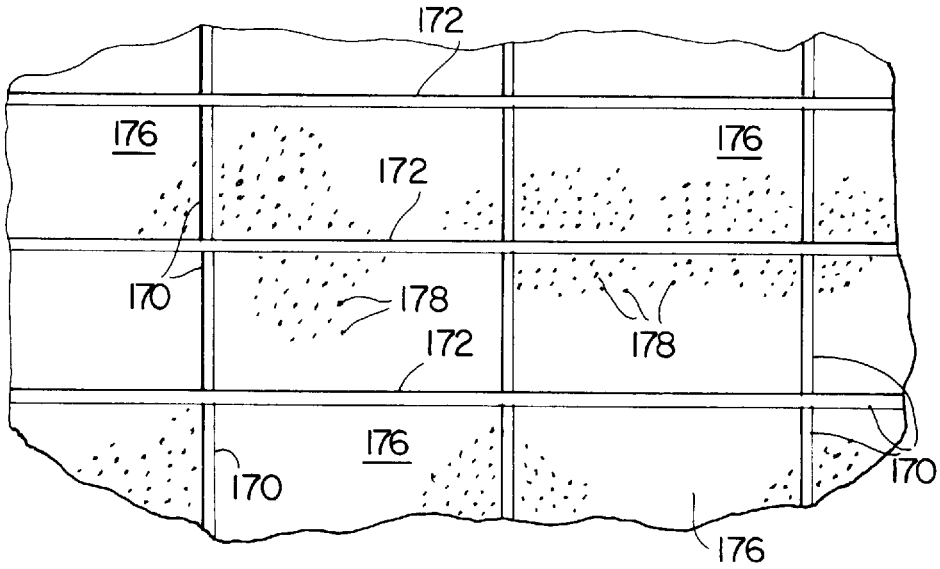
FIG. 16 is a bottom plan view of the embodiment of the invention illustrated in FIG. 15.

Apertures 178 can be arranged in any manner. For example, a constant pattern of apertures 178 can be provided in each tile 176. Alternatively, apertures 178 can be placed so as to provide continuity in the pattern of apertures 178 between adjacent tiles, as is shown in FIG. 16.

In any of the versions of the invention, the sheet assembly exposed surface may have indicia which is raised, stamped or painted, in order to provide an ornamental appeal when the room is illuminated naturally or by another light source, or by the accent lighting such as 66, 100. It should also be appreciated that either version could be manufactured as large or as small as desired by an end user. For larger units, the hole size would necessarily be increased according to the distance of the assembly from the viewer.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

I claim:

1. A ceiling ornament system for a ceiling mounted light arrangement comprising:

a parabolically shaped assembly formed with decorative indicia supported from the ceiling, wherein said parabolically shaped assembly comprises a series of interconnected sections, each of said sections being joined together along abutting flanges formed on each of said sections and extending from the center of said parabolically shaped assembly to the periphery of said parabolically shaped assembly;

said light arrangement being formed by a horizontally disposed lighting means, providing illumination of said lighting means and having a base depending directly from the bottom of the ceiling; and means securing said parabolically shaped assembly to the ceiling at a locus defined by the maximum distance between the bottom of the ceiling and the curvature of said parabolically shaped assembly.

2. The ceiling ornament system of claim 1, wherein said securing means comprises a single support stud arrangement extending between the bottom of the ceiling and the center of said parabolically shaped assembly.

3. The ceiling ornament system of claim 1, wherein said light arrangement comprises fluorescent lighting fixtures.

4. A ceiling ornament system for a ceiling mounted light arrangement comprising:

a parabolically shaped assembly formed with decorative indicia supported from the ceiling;

said light arrangement being formed by a horizontally disposed lighting means, providing illumination of said lighting means and having a base depending directly from the bottom of the ceiling;

means securing said parabolically shaped assembly to the ceiling at a locus defined by the maximum distance between the bottom of the ceiling and the curvature of said parabolically shaped assembly; and accent lighting disposed adjacent the periphery of said parabolically shaped assembly.

5. A ceiling ornament system for a ceiling mounted light arrangement comprising:

a parabolically shaped assembly formed with decorative indicia supported from the ceiling:

said light arrangement being formed by a horizontally disposed lighting means, providing illumination of said lighting means and having a base depending directly from the bottom of the ceiling; and means securing said parabolically shaped assembly to the ceiling at a locus defined by the maximum distance between the bottom of the ceiling and the curvature of said parabolically shaped assembly, wherein said securing means comprises a plurality of brackets extending between the bottom of the ceiling and the periphery of said parabolically shaped assembly.

6. The ceiling ornament system of claim 5, including drive means for rotating said parabolically shaped assembly relative to the ceiling, wherein said drive means is located between the bottom of the ceiling and the top of said parabolically shaped assembly and mounted on one of said brackets.

7. The ceiling ornament system of claim 6, wherein said drive means comprises a motor driven gear wheel fixed on said one of said brackets and a gear track mounted on said parabolically shaped assembly, said gear wheel being engageable with said gear track to rotate said parabolically shaped assembly.

8. A ceiling ornament system for a ceiling mounted light arrangement comprising:

a parabolically shaped assembly formed with decorative indicia supported from the ceiling;

said light arrangement being formed by a horizontally disposed lighting means, providing illumination of said lighting means and having a base depending directly from the bottom of the ceiling; and means securing said parabolically shaped assembly to the ceiling at a locus defined by the maximum distance between the bottom of the ceiling and the curvature of said parabolically shaped assembly;

wherein said parabolically shaped assembly includes an outer surface having the decorative indicia thereon and wherein said decorative indicia further includes an array of pin holes through which said illumination directly passes.

9. The ceiling ornament system of claim 8, wherein said parabolically shaped assembly is stationary with respect to the ceiling.

10. The ceiling ornament system of claim 8, wherein said parabolically shaped assembly is rotatable with respect to the ceiling.

11. The ceiling ornament system of claim 1, wherein said parabolically shaped assembly is formed from a non-translucent material.

12. A ceiling ornament system for a ceiling mounted light arrangement comprising:

a parabolically shaped assembly formed with decorative indicia supported from the ceiling, wherein said parabolically shaped assembly comprises a series of interconnected sections, each section including a pair of flanges located one at opposite side edges defined by each section, wherein adjacent sections are joined together by means of a rib member having passage means for receiving said flange;

said light arrangement being formed by a horizontally disposed lighting means, providing illumination of said lighting means and having a base depending directly from the bottom of the ceiling; and means securing said parabolically shaped assembly to the ceiling at a locus defined by the maximum distance between the bottom of the ceiling and the curvature of said parabolically shaped assembly.

13. A ceiling ornament system for a ceiling mounted light arrangement, comprising:

a parabolically shaped assembly constructed from a series of assembled sections mounted to the ceiling, wherein each section includes a sheet-like member having light-transmissive openings therein and one or more flanges, wherein the flanges abut each other when the sections are placed adjacent each other, and further comprising fasteners extending between the flanges of adjacent sections to secure the sections together; and lighting means disposed between the parabolically shaped assembly and the ceiling.

14. A ceiling ornament system for a ceiling mounted light arrangement comprising:

a parabolically shaped assembly constructed from a series of assembled sections mounted to the ceiling, wherein said sections are provided with flanges which abut each other when the sections are placed adjacent each other, and further comprising fasteners extending between the flanges of adjacent sections to secure the sections together; and lighting means disposed between the parabolically shaped assembly and the ceiling;

wherein the parabolically shaped assembly, formed of the assembled sections, is secured stationarily to the ceiling via a stud arrangement mounted to the ceiling and having a threaded depending member extending through substantially the center of the assembled sections; and a mounting nut engageable with the threaded stud for engaging the sections to secure the assembled sections to the ceiling.

15. A ceiling ornament system for a ceiling mounted light arrangement, comprising:

a parabolically shaped assembly constructed from a series of assembled sections mounted to the ceiling, wherein said sections are provided with flanges which abut each other when the sections are placed adjacent each other, and further comprising fasteners extending between the flanges of adjacent sections to secure the sections together; and lighting means disposed between the parabolically shaped assembly and the ceiling;

wherein the assembled sections are mounted to the ceiling so as to be rotatable about a substantially vertical axis extending through the center of the assembled sections; and a selectively operable drive arrangement for imparting rotation to the assembled sections.

16. The ceiling ornament system of claim 15, wherein the drive arrangement comprises a motor interposed between the assembled sections and the ceiling, a gear wheel driven in response to operation of the motor, and a gear track mounted to the assembled sections and engageable with the gear wheel so as to provide rotation of the assembled sections upon operation of the motor.

17. A method of ornamenting a ceiling having a light arrangement, comprising the steps of:

securing a series of ornament sections together to form a ceiling ornament having a center and an outer peripheral edge, wherein each ornament section includes a sheet-like member having light-transmissive openings therein for providing transmission of light from the light arrangement, wherein the sections each include one or more flanges one or more edges defined thereby, and wherein the sections are secured together by securing the flanges of adjacent sections to each other; and mounting the assembled sections to the ceiling so as to enclose the light arrangement so that, when the light arrangement is illuminated, the light transmitted thereby is transmitted through the light-transmissive openings in the assembled sections and is visible from below the ceiling ornament.

18. A method of ornamenting a ceiling, comprising the steps of:

mounting a light arrangement to the ceiling;

securing a series of ornament sections together to form a ceiling ornament having a center and an outer peripheral edge the sections being formed so as to provide selective transmission of light through holes formed therein from the light arrangement wherein the sections each include flanges along their edges, and wherein the sections are secured together by securing the flanges of adjacent sections to each other; and mounting the assembled sections to the ceiling so as to enclose the light arrangement so that, when the light arrangement is illuminated, the light transmitted thereby is transmitted through the holes in the assembled sections and is visible from below the ceiling ornament;

wherein the step of mounting the ornament to the ceiling comprises stationarily mounting the ornament such that the outer peripheral edge of the ornament engages the ceiling and the central portion of the ornament is spaced below the ceiling.

19. A method of ornamenting a ceiling, comprising the steps of:

mounting a light arrangement to the ceiling;

securing a series of ornament sections together to form a ceiling ornament having a center and an outer peripheral edge, the sections being formed so as to provide selective transmission of light through holes formed therein from the light arrangement;

mounting the assembled sections to the ceiling so as to enclose the light arrangement by supporting the outer peripheral edge of the assembled sections at a location space below the ceiling, wherein the ornament is shaped such that the central portion of the ornament is spaced above the outer peripheral edge thereof, and wherein the outer peripheral edge of the ornament is supported such that the ornament is rotatable about a substantially central vertical axis;

wherein, when the light arrangement is illuminated, the light transmitted thereby is transmitted through the holes in the assembled sections and is visible from below the ceiling ornament, and selectively imparting rotation to the ornament.

20. The method of claim 19, wherein the step of selectively imparting rotation to the ornament comprises mounting a selectively operable motor between the ornament and the ceiling, engaging an output shaft associated with the motor with a gear wheel, engaging the gear wheel with a gear track secured to the ornament, and selectively operating the motor so as to impart rotation to the ornament through the gear wheel and the gear track.

21. A ceiling ornament system for a ceiling mounted light arrangement comprising:

an opaque tile arrangement located below the ceiling and below the light arrangement, wherein the tile arrangement includes a series of substantially coplanar individual tiles, each of which defines a substantially continuous lower surface, wherein the tiles are provided with light-transmissive openings which vary in location from tile to tile, wherein the light-transmissive openings enable light to pass from the light arrangement through the lower surfaces of the tiles.

22. A ceiling ornament system for a ceiling mounted light arrangement comprising:

an opaque tile arrangement located below the ceiling, wherein the tile arrangement includes a series of tiles, each of which defines a substantially continuous lower surface, wherein the tiles are provided with light-transmissive openings which vary in location from tile to tile, wherein the light-transmissive openings enable light to pass from the light arrangement through the lower surface of the tiles;

wherein the tile arrangement comprises a series of rails suspended from the ceiling and defining a series of spaces, wherein the individual tiles are placed within the spaces.

23. The ceiling ornament system of claim 21, wherein the apertures formed in the tiles are placed so as to provide a pattern which is continuous between adjacent tiles.

24. A ceiling ornament system, comprising:

a light source adapted for mounting to a ceiling;

a non-translucent member mounted to the ceiling and having an opaque surface which prevents emission of light from the light source to a location below the non-translucent member; and a series of irregularly located light-transmissive openings formed in the opaque surface of the non-translucent member, wherein the openings function to emit light through the non-translucent member.

25. The system of claim 24, wherein the non-translucent member defines a peripheral outer edge, and wherein the non-translucent member is mounted to the ceiling such that the peripheral outer edge is engaged with the ceiling to prevent passage of light therethrough.

26. The system of claim 24, wherein the non-translucent member defines a peripheral outer edge and is mounted to the ceiling such that the peripheral outer edge is spaced below the ceiling, and further comprising closure structure interposed between the peripheral outer edge and the ceiling for preventing emission of light past the peripheral outer edge.

* * * * *

UNITED STATES PATENT AND TRADEMARK OFFICE
CERTIFICATE OF CORRECTION

PATENT NO. : 5,772,314

DATED : June 30, 1998

INVENTOR(S) : DARYL J. BRUMMER

It is certified that error appears in the above-identified patent and that said Letters Patent is hereby corrected as shown below:

Claim 11, column 7, line 40, delete "1" and substitute therefor -- 8--; Claim 18, column 9, line 6, after "edge" insert -- , --; Claim 18, column 9, line 8, after "arrangement" insert -- , --; Claim 19, column 9, line 45, after "ornament" insert --;--

Signed and Sealed this

Nineteenth Day of October, 1999

*Attest:*

Q. TODD DICKINSON

*Attesting Officer*

*Acting Commissioner of Patents and Trademarks*